US006189158B1

(12) United States Patent
Lehoux

(10) Patent No.: US 6,189,158 B1
(45) Date of Patent: Feb. 20, 2001

(54) REST SUPPORT FOR A GUITAR

(76) Inventor: Randy A. Lehoux, 146A Jagger Mill Rd., Sanford, ME (US) 04073

( * ) Notice: Under 35 U.S.C. 154(b), the term of this patent shall be extended for 0 days.

(21) Appl. No.: 09/435,699

(22) Filed: Nov. 8, 1999

(51) Int. Cl.[7] ..... A41D 13/00
(52) U.S. Cl. ..... 2/455; 2/1; 224/661; 224/907
(58) Field of Search ..... 2/46, 464, 465, 2/338, 911, 312–314, 319, 455; 224/251, 661, 908, 907, 910; 602/23

(56) References Cited

U.S. PATENT DOCUMENTS 4,453,271 * 6/1984 Donzis ..... 2/455
4,930,695 * 6/1990 Thompson et al. ..... 224/910
5,205,448 * 4/1993 Kester ..... 224/908
5,503,315 * 4/1996 Ruzika et al. ..... 224/910
5,584,072 * 12/1996 Kin et al. ..... 2/22
5,718,364 * 2/1998 McDowell ..... 224/661
5,765,738 * 6/1998 Hoffner ..... 224/661
5,791,538 * 8/1998 Bain, III ..... 2/22
6,039,677 * 3/2000 Spletzer ..... 2/22
6,065,659 * 3/2000 Faz ..... 224/661

* cited by examiner

*Primary Examiner*—Gloria M. Hale
*Assistant Examiner*—Tejash Patel
(74) *Attorney, Agent, or Firm*—William F. Hamrock

(57) ABSTRACT

A rest support for a guitar which is supported by a support system which holds the guitar in the front of the player's body with the strumming end of the guitar hanging close to the player's hip. The rest support encompasses a resilient, flexible cushioned enclosure mountable on the upper thigh below the hip. The cushioned enclosure extends outwardly from thr thigh forming a pillow or wedge or cushioned rest upport for the strummung end of the guitar to rest against which transfers some of the weight to the guitar to the player' leg. The thickness of the enclosure is set so that a near perfect angle is created for the resting guitar providing a better view of both the strumming end and the fret end of the guitar reducing the number of wrist and arm movements and allowing for faster attack on the guitar strings. The cushioned enclosure is releasably attached to the player by means of an adjustable looped strap

10 Claims, 3 Drawing Sheets

REST SUPPORT FOR A GUITAR

BACKGROUND OF THE INVENTION

The present invention relates to a rest support for supporting and positioning a guitar or similar instrument, hereinafter referred to as a guitar, which is supported by a shoulder strap or waiste belt or other system that allows the guitar to hang down in the vacinity of the the player's hip at the strumming end of the guitar, to uniformly distribute the the weight of the guitar over the player's upper leg area and more comfortably postioning the guitar at the front of the player for better viewing and at better angles for playing.

The weight of a guitar is very heavy and uncomfortable to hold over long periods of time. Various suspension systems for supporting the guitar on the front of the body have been used. Types of suspension strap systems commonly used are shoulder strap systems, waiste strap systems and other systems wherein the strumming end of the guitar hangs loosely at the hip area of the player. The difficulties with this positioning of the guitar are that the loosely hanging weight at the strumming end of the instrument requires the player to support it with various parts of the upper body and also the player is required to be continuously maneuvering the guitar into a better position to view the guitar and into a better playing angle. Within a period of time, the player develops fatigue and discomfort caused to some extent by this positioning of the guitar. Applicant has recently developed a Double Strap Harness for a Guitar, U.S. patent application Ser. No. 09/363,812, filed Jul. 30, 1999, and a Harness Attachment for a Guitar, U.S. patent application, filed, which overcome the defeciencies of prior shoulder strap systems. The present invention is directed to improving the effeciencies of all guitar support systems where the strumming end of the guitar hangs loosely at the hip area of the player.

SUMMARY OF THE INVENTION

The present inventions overcomes the deficiencies of these prior art guitar support systems where the strumming end or bottom end of the guitar hangs loosely at the player's hip area by helping to support and position the guitar in the front of the body. This is accomplished with the present uniquely positioned guitar rest support attached around the upper thigh area of the player's leg adjacent to the strumming end of the guitar.

The present guitar rest support encompasses a resilient, flexible cushioning material or air filled enclosure housing relesably mounted on the player's outer, upper front thigh area below the hip. The rest support extends outwardly from the front of the thigh area forming a pillow or wedge or rectangular shaped cushioned rest support for the strumming end of the guitar to rest against which transfers some of the weight of the guitar to the player's leg. The thickness of the rest support is set so that a near perfect angle is created for the resting guitar providing a better view of both the strumming end and the fret end or upper end of the guitar. The improved angle position results in a reduction in the number of wrist and arm movements by the player and allows for faster attack of the guitar strings. The top of the rest support can be attached to the player's pants, clothing, waiste belt, or suspension system for the guitar by means of a releasable hanging strap which is movably mounted thereon. Thus, by combining the present rest support with the various guitar supports, there is a more uniform distribution of the weight and a near perfect angle is provided for playing in a more comfortable position, none of which has been previously obtainable.

DETAILED DESCRIPTION OF THE PREFERRED EMBODIMENT

Figure 1:
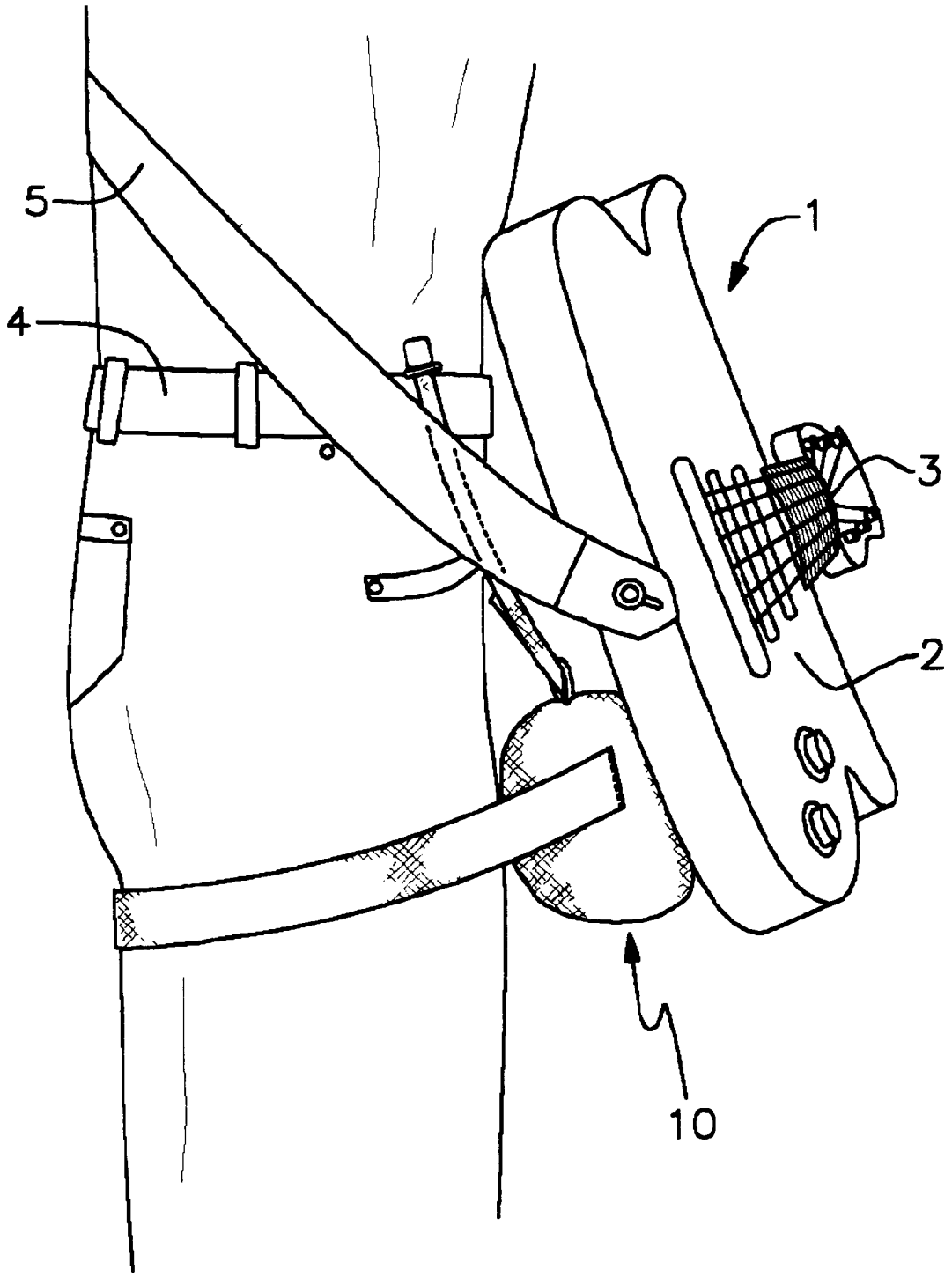
FIG. 1 is a view of a player wearing a rest support of the invention supporting a guitar.

FIG. 1 illustrates a player wearing a rest support 10 of the invention helping to support a guitar 1 at the front of the player's body. Shown are the low hanging strumming end 2 and the upper fret end 3 located at opposite ends of the guitar, an example of a waiste belt 4, and an illustration of a prior art shoulder strap harness 5 as an example of a support system mounting a guitar on a player. The present rest support is applicable with any support system which provides the strumming end of the guitar to hang loosely at the player's hip area.

Figure 2:
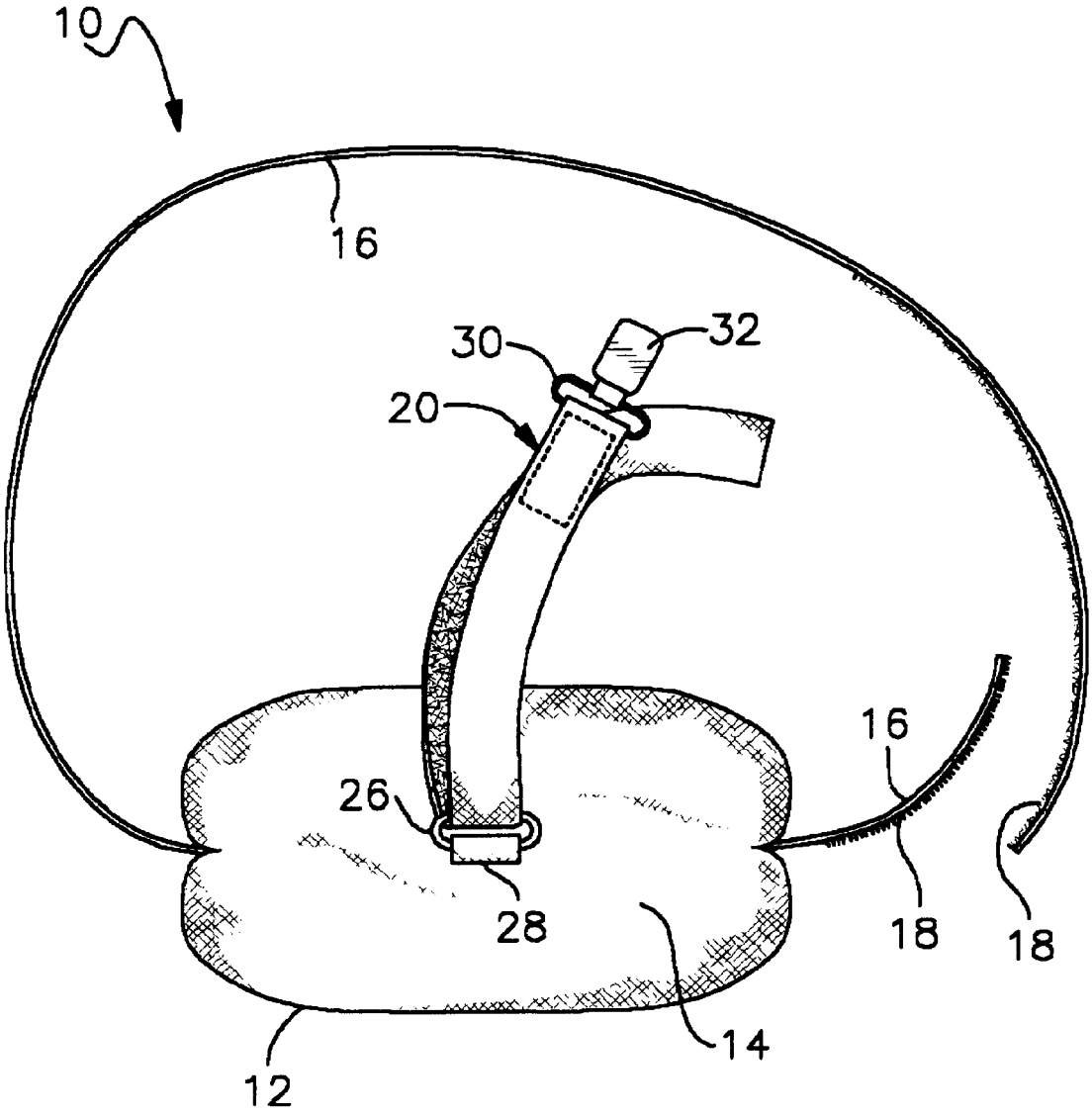
FIG. 2 is a detailed view of one embodiment of the rest support of the invention.

Shown in FIG. 2 is a detailed isolated view of one preferred embodiment of rest support 10 of the invention and is the embodiment illustrated in FIG. 1 releasably attached to the player's upper thigh area below the hip. Rest support 10 as seen in FIG. 2 includes a covering 12 which can be friction surfaced enhanced such as a frictionized fabric or a frictionized rubber or elastomeric or plastic covering. Covering 12 completely encases a resilient enclosed foam material forming a rectangular shaped cushion support 14 with rounded edges. The enclosed material can be any type of substance such as a plastic or elastomeric cushioning material, an air filled cushion or combination of materials or any material that makes an equivalent cushioned support. The cushion support is generally about six inches in lenght and about three inches in thickness but other dimensions are applicable which provide the optimum cushioning as well as the support characteristics required. Adjustable thigh straps 16 having securing means 18, such as velcro or equivalent securing means, on mating surfaces extend outwardly from each end of the cushion support to be releasably and adjustably secured to each other around the player's thigh snugly engaging the cushion support to the front thigh area in a horizontal position. Other adjustable securing means such as a strap adjuster are permitted.

Cushion support 14 as seen in FIG. 1 is adjustably attached upwardly to the waiste belt, but it can be attached to other points of contact such as either the player's clothing or waist belt or guitar support system, by means of adjustable loop strap 20. The loop strap is made of resilient durable fabric or similar material having securing means 22, such as velcro or equivalent securing means, on mating surfaces which are releasably and adjustably secured to each other in forming long loop 24.The loop strap at the lower end of long loop 24 is slidably looped through the top bar of double bar fabric connecting bracket 26 which may be a double metal bar connecting bracket. Connecting bracket 26 is movably connected through its bottom bar to small loop strap 28 secured to the top surface of covering 12. The upper end of loop strap 20 is movably looped around connecting bar 30 of suspender clip 32 by sewing to itself forming small suspender loop 34. Suspender clip 32 is releasably mounted on waste belt 4.

Figure 3:
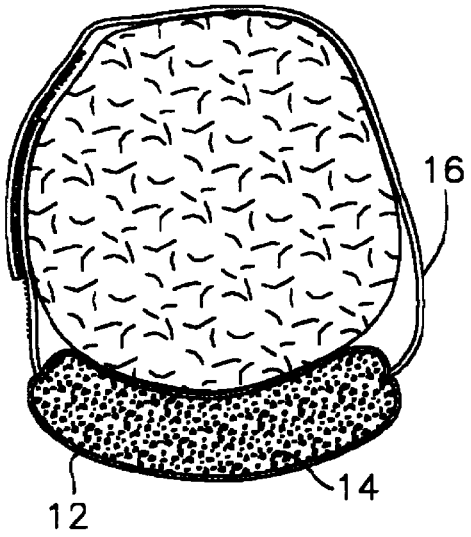
FIG. 3 is a top view illustrating an embodiment of how the rest support encompasses the leg.

Each of the above three connections:

of the upper end of loop strap 20 being movably mounted by suspender loop 34 on connecting bar 30 of suspender clip 34;

of the lower end of long loop 24 of loop strap 20 being movably connected to the top bar of connecting bracket 26;

and of the small loop strap 28 being movingly connected to the bottom bar of connecting bracket 26;

is movably mounted by a connecting loop formed at its connection on the bar of the connecting device. One of the benefits of these two small loop connections 28 and 34 and of long loop 24 connection is that it allows a portion of the weight of the strumming end of the guitar to be distributed away from the sensitive body muscles and placed on a more comfortable upper thigh leg position when the guitar is moved about. For example,when the strumming end is resting on cushion support 14, as illustrated in FIG. 3, it is positioned outwardly from the front hip wherein gravity presses the guitar weight against the the cushion support distributing the weight of the guitar to the player's leg and to the waiste belt or clothing. In addition to the distribution of the weight, a further benefit is that the guitar is now positioned at a better angle for the player to actually see and play it.

Figure 4:
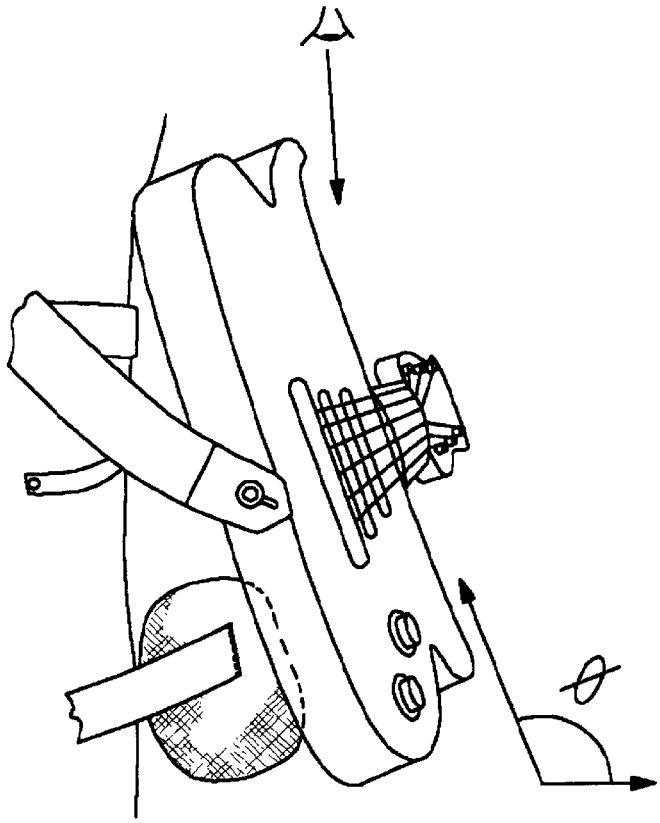
FIG. 4 is a view illustrating the near perfect angle of the guitar provided by the rest support of the invention.

FIG. 4 illustrates how the guitar is placed in a near perfect angle outside of the front area of the hip which provides a near perfect position for the wrists to have a faster attack on the strings while allowing for fewer wrist and arm movements and also presenting a better view of the fret end of the guitar.

As seen in FIG. 1, rest support 10 is releasably mounted on the upper right front thigh area and to waiste belt 4. The cushion support 14 extends about two to three inches outwardly from the front of the thigh area cushioning the weight of the strumming end of the guitar towards the leg and the waiste belt. Suspender clip 32 is seen clipped on to the player's waiste belt but there are no limitations as to where the suspender clip can be attached for instance to other areas of the player's clothing or to a another belt.

Figure 5:
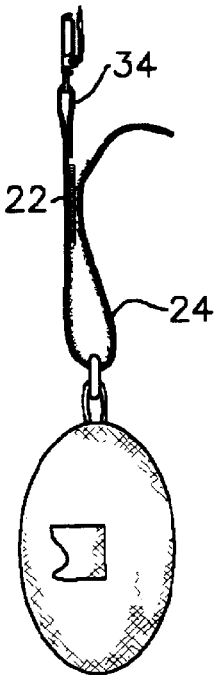
FIG. 5 is a view of a fabric bracket attached to a fabric loop.

A preferred connector fabric bracket 26 is shown connected through small loop fabric strap 28 secured to covering 12 by sewing to itself as seen in FIG. 5. Generally, it is a double bracket bar rectangular bracket, such as a dee, but also can be a multibar bracket or the fabric device bracket or similar device. It is also permissible to have long loop 20 slidingly attached to the waiste belt While the present invention has been described and illustrated with respect to the preferred embodiment, it will be appreciated that variations of the invention may be made without departing from the scope of the invention which is defined in the appending claims.

What is claimed is:

1. A rest support for supporting and positioning a guitar in front of a player, said guitar having a strumming end and a fret end and a support system where the strumming end hangs at the hip area of a player comprising the rest support comprising an outwardly extending cushioned foam enclosure bring releasably mountable by adjustable straps on the player's upper thigh and an upper releasably mountable attaching means thereon which is movably mountable on a waist belt on the player via a suspender means for positioning the guitar.

2. The rest support according to claim 1 wherein the cushioned enclosure has a friction enhanced outer surface.

3. The rest support according to claim 1 wherein the cushioned enclosure is a fabric enclosed foam material.

4. The rest support according to claim 1 wherein the cushioned enclosure is an air filled enclosure.

5. The rest support according to claim 1 wherein the cushioned enclosure has a front end and a back end and is releasably mountable by adjustable straps extending from each end around the player's thigh.

6. The rest support accoding to claim 5 wherein the adjustable strap have surface engaging means on mating surfaces.

7. The rest support according to claim 1 wherein the releasable attaching means comprises a loop strap movably mountable to the cushion support.

8. The rest support according to claim 7 wherein the loop strap is slidingly connected to a loop connector.

9. The rest support according to claim 8 wherein the loop connector is prepared from fabric.

10. The rest support according to claim 9 wherein the loop connector is movably mounted on a looped fabric secured to the cushion support.

* * * * *